US005447284A

United States Patent [19]

Heinz

[11] Patent Number: 5,447,284

[45] Date of Patent: Sep. 5, 1995

[54] MOUNTING BRACKET FOR ARROW REST

[76] Inventor: Jeffrey J. Heinz, 11762 Galapago Ct., Northglenn, Colo. 80234

[21] Appl. No.: 192,110

[22] Filed: Feb. 4, 1994

[51] Int. Cl.[6] ..... F41B 5/22

[52] U.S. Cl. ..... 124/44.5; 248/276.1; 124/24.1

[58] Field of Search ..... 248/276, 225.31, 278; 124/21, 25, 24.1, 44.5, 86, 24, 41.1; 403/381, 333, 339, 337

[56] References Cited

U.S. PATENT DOCUMENTS

| | | | |
|---|---|---|---|
| 3,935,854 | 2/1976 | Troncosco, Jr. | 124/24 |
| 4,074,674 | 2/1978 | Simo | 124/41 A |
| 4,236,497 | 12/1980 | Troncoso, Jr. | 124/24 |
| 4,299,195 | 11/1981 | Norris | 124/24 |
| 4,324,221 | 4/1982 | Peck | 124/24 |
| 4,372,282 | 2/1983 | Sanders | 124/24 |
| 4,398,528 | 8/1983 | Troncoso, Jr. | 124/24 |
| 4,453,528 | 6/1984 | Eckert | 124/41 |
| 4,548,188 | 10/1985 | Simo | 124/41 |
| 4,608,959 | 9/1986 | Seynaeve | 124/24 |
| 4,632,087 | 12/1986 | Cline | 124/41 |
| 4,664,093 | 5/1987 | Nunemaker | 124/24 |
| 4,686,956 | 8/1987 | Troncoso, Jr. | 124/41 |
| 4,732,135 | 3/1988 | Simo | 124/41 |
| 4,748,963 | 6/1988 | Troncoso et al. | 124/24 |
| 4,748,964 | 6/1988 | Troncoso, Jr. | 124/41 |
| 4,803,971 | 2/1989 | Fletcher | 124/41 |
| 4,809,670 | 3/1989 | Simo | 124/41 |
| 4,827,895 | 5/1989 | Troncoso, Jr. | 124/41 |
| 4,838,237 | 6/1989 | Cliburn | 124/41 |
| 4,865,008 | 9/1989 | Troncoso | 124/41 |
| 4,881,515 | 11/1989 | Simo | 124/24 |
| 4,889,307 | 12/1989 | Klansek | 248/690 |
| 4,899,716 | 2/1990 | Martin et al. | 124/41 |
| 4,924,841 | 5/1990 | Smith | 124/44.5 |
| 4,947,823 | 8/1990 | Larson | 124/41.1 |
| 4,967,722 | 11/1990 | Roberts | 124/44.5 |
| 5,009,215 | 4/1991 | Ludwig | 124/44.5 |
| 5,085,201 | 11/1991 | Tepper et al. | 124/44.5 |
| 5,095,884 | 3/1992 | Mertens | 124/44.5 |
| 5,107,818 | 4/1992 | Simo | 124/41.1 |
| 5,137,006 | 8/1992 | Gallops | 124/44.5 |
| 5,148,796 | 9/1992 | Simo | 124/44.5 |
| 5,161,515 | 11/1992 | Hammonds | 124/44.5 |
| 5,179,930 | 1/1993 | Simo | 124/44.5 |
| 5,190,023 | 3/1993 | Sacco | 124/44.5 |
| 5,213,090 | 5/1993 | Tone | 124/44.5 |
| 5,245,980 | 9/1993 | Colvin | 124/24.1 |
| 5,251,606 | 10/1993 | Colvin | 124/44.5 |
| 5,285,764 | 2/1994 | Mertens | 124/44.5 |
| 5,322,048 | 6/1994 | Baker | 124/44.5 |

*Primary Examiner*—Karen J. Chotkowski
*Assistant Examiner*—Catherine S. Collins
*Attorney, Agent, or Firm*—Lee R. Osman; Holland & Hart

[57] ABSTRACT

A mounting bracket mountable on a bow for removably attaching and precisely calibrating an arrow support mechanism. The mounting bracket includes a mounting plate and a module releasably attachable thereto. The mounting plate is attachable to the bow and has an alignment surface integrally formed thereon. The module also has a corresponding integrally formed alignment surface. When the mounting plate and the module are releasably attached together, the alignment surfaces seatingly engage one another to automatically and repeatably position the module in a predetermined aligned relationship with the mounting plate, and thereby the bow.

10 Claims, 4 Drawing Sheets

Fig_3
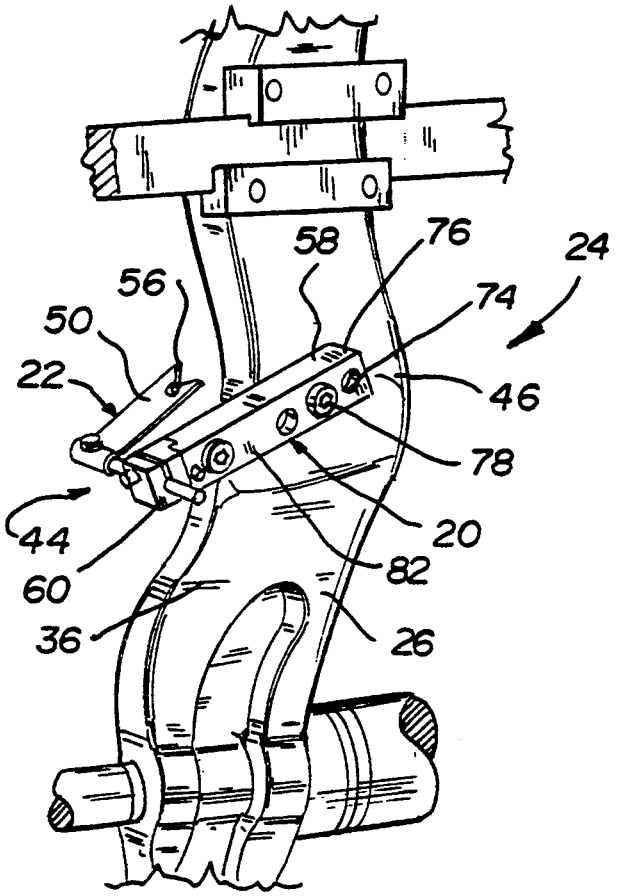
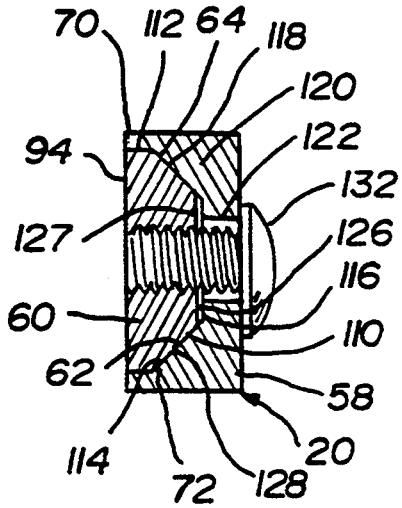
Fig_5
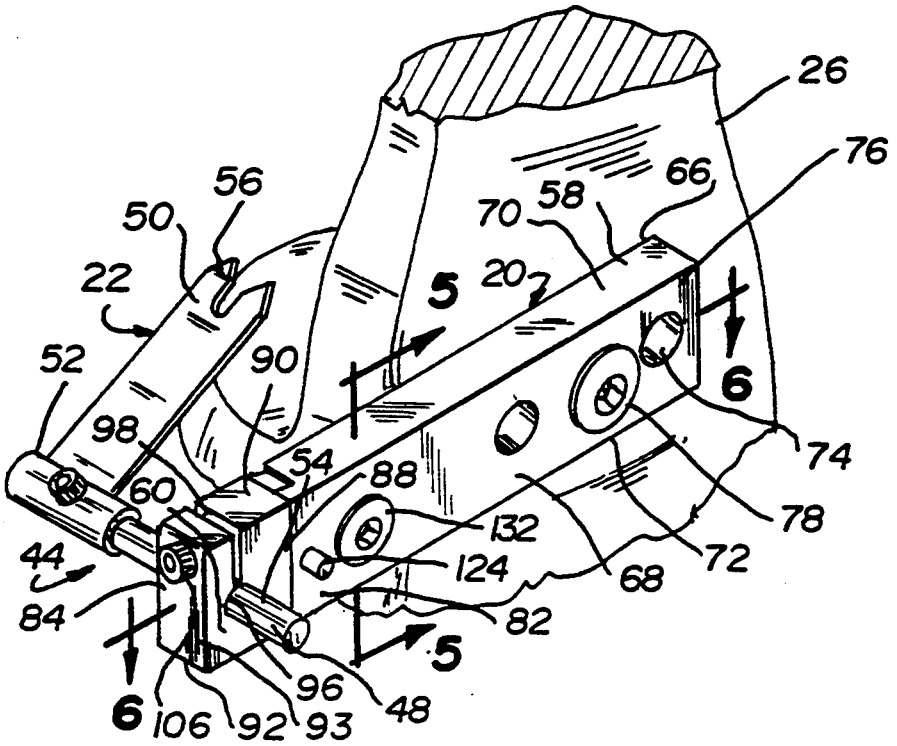
Fig_4

MOUNTING BRACKET FOR ARROW REST

BACKGROUND OF THE INVENTION

1. Field of the Invention

The present invention relates to archery, and more particularly an arrow rest and sight on a bow.

2. Description of the Prior Art

Archery bows and arrows have been utilized for many years for war, sport, and target competition. The precision with which an archer is able to aim at and hit a target with an arrow is a key factor in successfully using an archery bow. An arrow rest mounted on the bow greatly affects precision and accuracy of shooting the arrow from the bow. The arrow rest is sighted-in by the archer to accommodate the archer's personal technique and obtain precision and accuracy in hitting a target. As such, sighting-in an arrow rest requires a considerable amount of time and patience.

Typically, an arrow rest remains attached to the bow after being sighted-in. If the bow is used or carried after the arrow rest has been sighted-in, the arrow rest is at risk of becoming decalibrated by contact with any object it encounters, including damage from being transported and inadvertent contact during use. Any change in the arrow rest's calibration greatly affects the accuracy and precision of the bow and arrow in striking a target. Also, many arrow rests, if removed from the bow, require complete realignment and recalibration, such as in U.S. Pat. No. 3,935,854.

Additionally, where accuracy and precision are of utmost importance, such as at an archery competition, arrow rests calibrated for one type of arrow can be useless if a different arrow is used with the bow. Many arrow rests must be recalibrated for each different type of arrow to be used with the bow. Conversely, if more than one archer uses the same bow, the arrow rest must be sighted-in for each individual user to obtain optimal accuracy and precision.

U.S. Pat. Nos. 4,881,515 and 5,148,796 describe arrow rests that are laterally adjustable and replaceable. The structures of the '515 and '796 patents are similar to each other, but are both unrelated to the present invention. A first part of the arrow rest mounts axially through a hole in the bow perpendicular to the bow's longitudinal axis, with an engagement portion within the hole and adjacent to the arrow side of the bow. A second part of the arrow rest releasably attaches to the engagement portion of the first part in a male/female relationship on the arrow side of the bow. The structure of the arrow rests and the way that the arrow rests are separated and re-attached do not suggest the structural features incorporated in the present invention.

It is with respect to these considerations and other background information relative to prior art mounting bracket mechanisms for arrow rests that the significant improvements of the present invention have evolved.

OBJECTS AND SUMMARY OF THE INVENTION

The principal object of the present invention is to provide an improved mounting bracket for supporting a precisely calibrated arrow support mechanism on a bow.

Another object of the present invention is to provide an improved mounting bracket of the foregoing character that allows the calibrated arrow support mechanism to be removed and remounted in a predetermined aligned relationship so as to not require re-calibration of the arrow support mechanism.

In accordance with the foregoing objects, the present invention is embodied in a mounting bracket releasably attached to an archery bow and to which is attached an arrow support mechanism, the mounting bracket automatically positioning the arrow support mechanism in a predetermined aligned relationship relative to the mounting bracket and thereby to the bow.

More specifically, the present invention is a new and improved mounting bracket comprising a mounting plate and a module releasably attachable to the mounting plate. The mounting plate is attachable to the bow and has an integrally formed alignment surface. The module has a corresponding integrally formed alignment surface. The alignment surface on the mounting plate seatingly engages the alignment surface on the module when the mounting plate and module are releasably attached together. The engagement of the two alignment surfaces automatically and repeatably positions the module in a predetermined aligned relationship relative to the mounting plate, and thereby the bow.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 3 is an enlarged rear partial perspective view of the bow shown in FIG. 1, illustrating the mounting bracket incorporating the present invention.

FIG. 4 is an enlarged partial perspective view of the bow as shown in FIG. 3, illustrating the mounting bracket incorporating the present invention.

FIG. 5 is a section view taken substantially along the plane of line 5—5 of FIG. 4.

DETAILED DESCRIPTION

Figure 1:
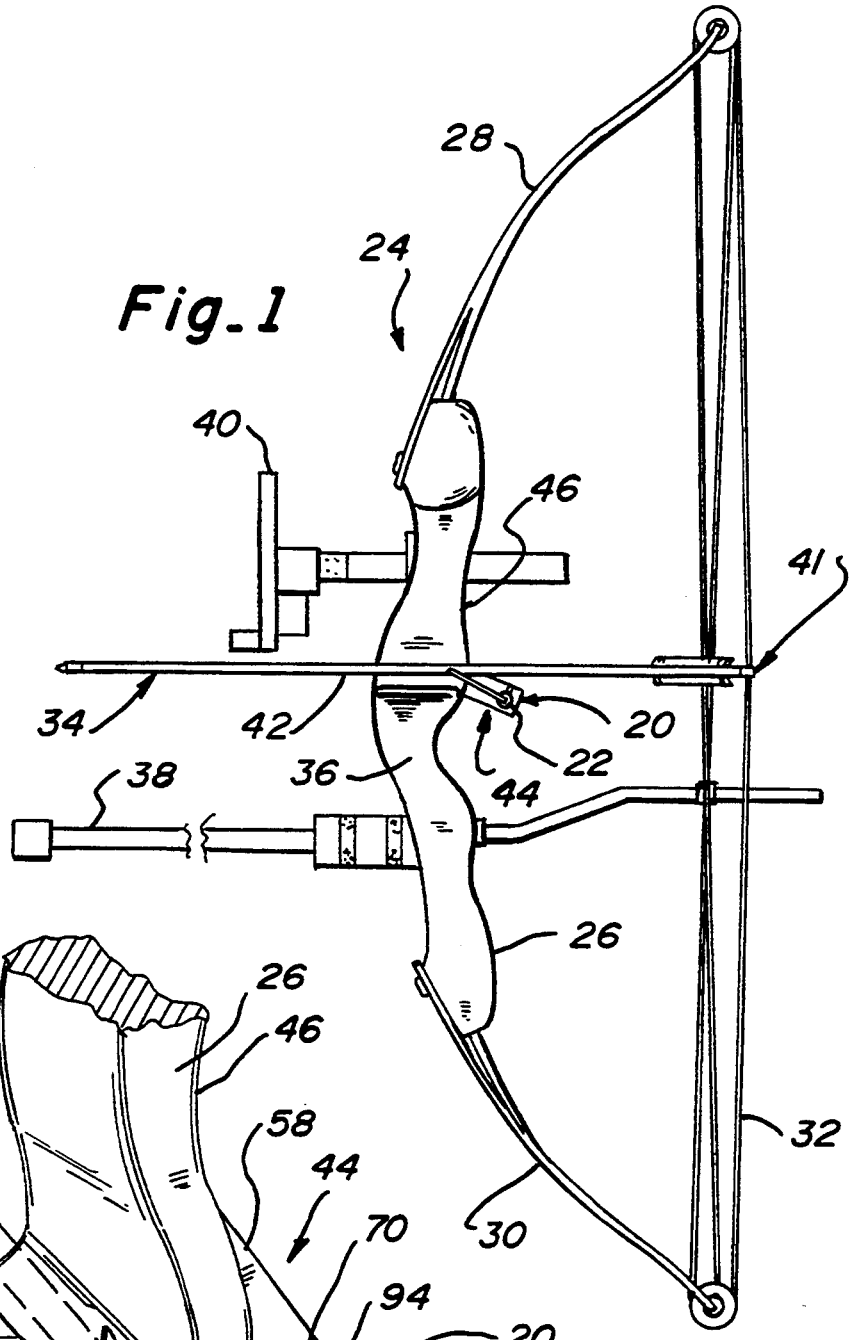
FIG. 1 is a side elevational view of a bow having a mounting bracket incorporating the present invention.

The present invention is embodied in an improved mounting bracket 20 for mounting an adjustable arrow support mechanism 22 on a bow 24. The bow, as shown in FIG. 1, comprises a riser 26, a pair of limbs 28, 30, each limb extending from an opposite end of the riser, and a string 32 stretching between distal ends of each of the limbs. The bow acts to impart a spring force, generated from drawing the bow and bending the limbs, to an arrow 34 releasably attached to the string. When the bow is drawn (not shown) and released, the spring force in the limbs is transferred through the string to the arrow, the arrow being propelled toward a target (not shown) upon releasing the string.

When shooting the arrow 34 from the bow 24, the bow is held by a handle 36 integrally formed adjacent to and below the midpoint of the riser 26. A stabilizer bar 38 and a sight scope 40 are also attached to the riser. Prior to releasing the arrow from the bow, the arrow engages the bow at two locations. The rear end of the arrow has a slot, or nock 41, engaging the string 32. The arrow is also supported along its shaft 42 by an arrow rest 44. The arrow rest is mounted on the riser adjacent to and above the handle.

The accuracy with which an arrow 34 can be aimed and released to strike the target depends in large part upon the engagement of the arrow rest 44 with the shaft 42 of the arrow. The arrow rest provides directional guidance to the arrow as it is released from the drawn bow 24. The arrow rest is adjustable to allow the archer to sight-in the arrow rest for accuracy in aiming the arrow and hitting the target.

Figure 2:
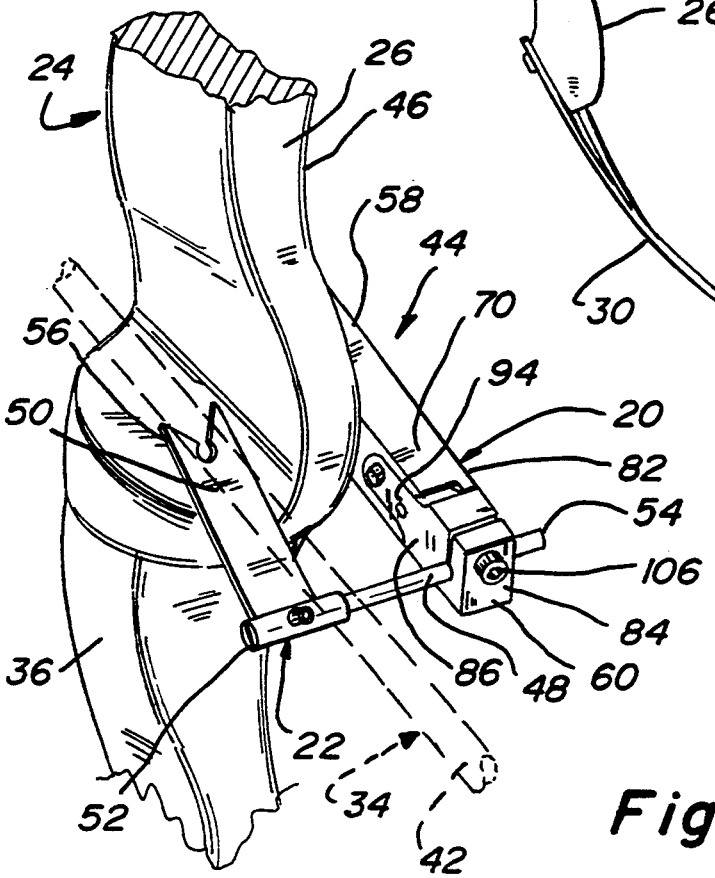
FIG. 2 is an enlarged rear partial perspective view of the bow as shown in FIG. 1, illustrating an arrow rest incorporating the mounting bracket of the present invention.

The arrow rest comprises the mounting bracket 20 and the arrow support mechanism 22 operably connected together in a general U-shape configuration, as seen in FIGS. 2, 3 and 4. The mounting bracket is securely attached to one side 46 of the riser 26 opposite of the side where the arrow 34 is positioned. The mounting bracket and the arrow support mechanism, when connected, wrap around the riser so that the arrow can rest upon the arrow support mechanism.

To sight-in the arrow rest 44 for a particular archer's needs, the mounting bracket 20 is first attached to the riser 26 at a preferred angle to generally position the location where the arrow support mechanism 22 contacts the arrow shaft 42. The arrow support mechanism is able to be adjusted independently from the mounting bracket, allowing for fine adjustment of the arrow support mechanism. The arrow support mechanism can be adjusted vertically to lift or lower the arrow shaft. The arrow support mechanism can also be adjusted longitudinally along the arrow shaft. Additionally, the arrow support mechanism is laterally adjustable to compensate for any side-to-side inaccuracies. Once the archer has sighted-in the arrow rest to provide accurate and consistent target results, the arrow support mechanism is fixed in place relative to the mounting bracket. At this point, the arrow rest is calibrated and is in a fixed position ready to be used.

Figure 7:
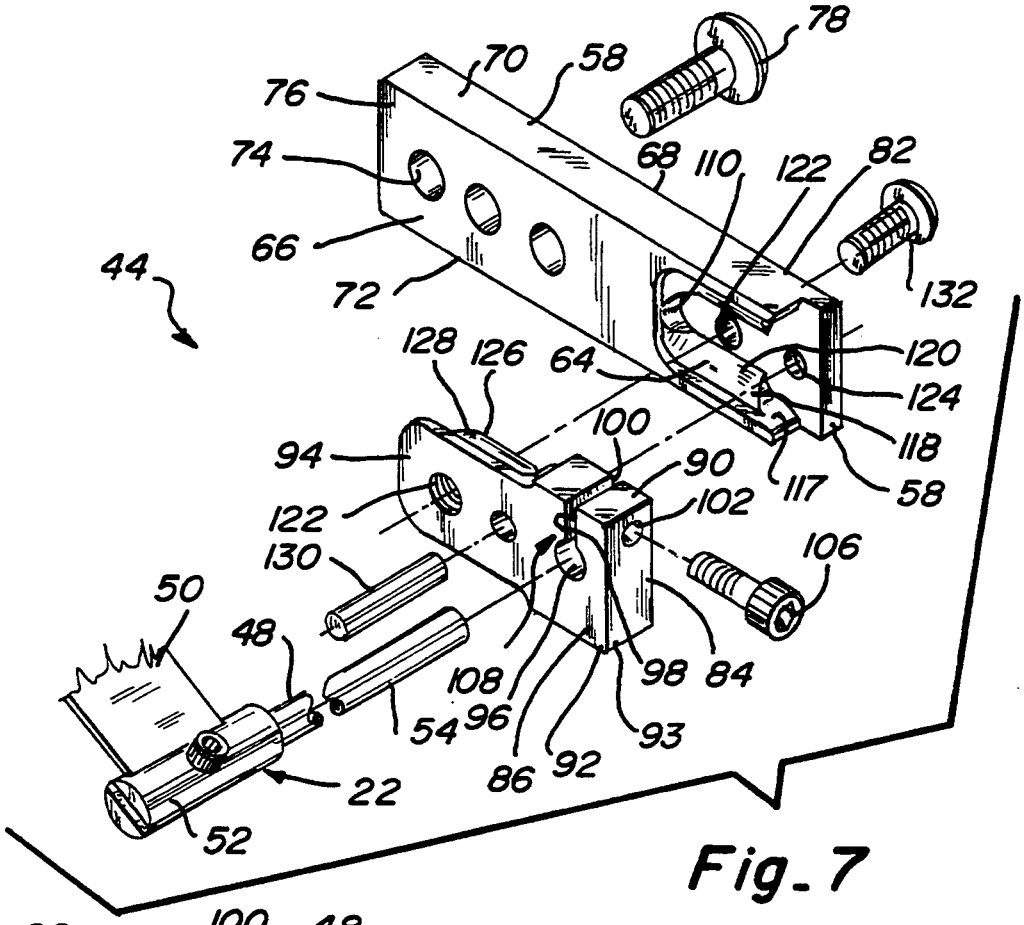
FIG. 7 is an exploded view of the mounting bracket incorporating the present invention, illustrating a mounting plate and a module.
Figure 8:
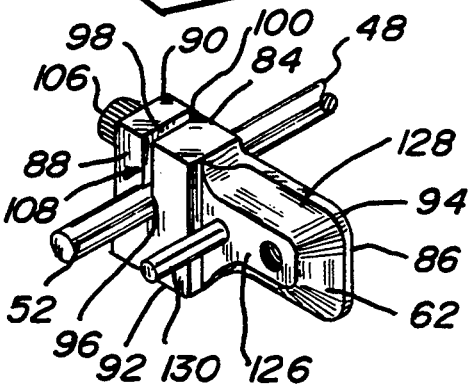
FIG. 8 is a perspective view of the module as shown in FIG. 7.

The mounting bracket 20 of the present invention comprises a mounting plate 58 which is secured to the bow riser and a separable module 60 connected to an end of the mounting plate. The arrow support mechanism 22 is adjustably attached to the module. The module and the mounting plate each have an alignment surface 62 and 64, respectively, that engage with one another when the module and the mounting plate are connected together. The engagement of the alignment surfaces 62 and 64 accurately positions the mounting plate and module in a predetermined aligned relationship, as shown in FIGS. 2, 5, and 7.

The arrow support mechanism 22 is known in the art, and consists of a lateral support rod 48 and an elongated resilient arm 50 releasably attached to and extending from a first end 52 of the lateral support rod. A second end of the lateral support rod 48 is adjustably attached to the module 60 to allow fine adjustment of the arrow support mechanism. A top end 56 of the arm 50 engages the arrow 34 along the arrow shaft 42 to provide directional guidance to the arrow when the arrow is released from the bow.

Figure 6:
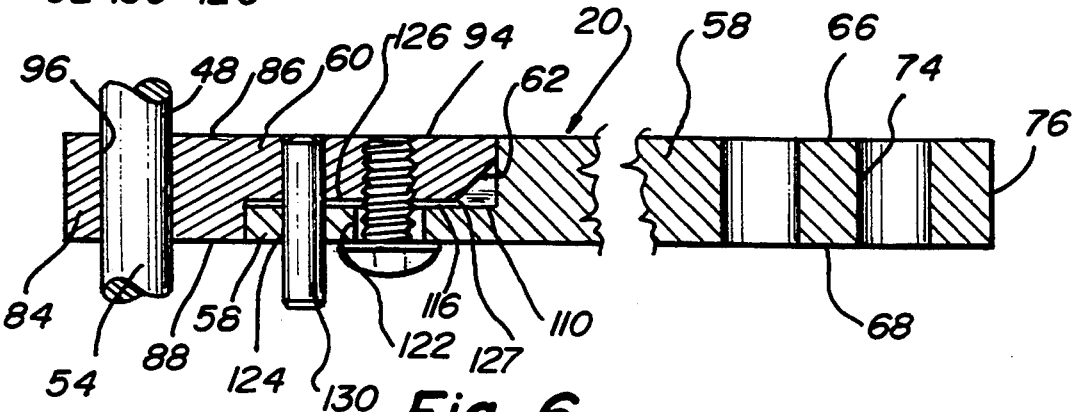
FIG. 6 is a section view taken substantially along the plane of line 6—6 of FIG. 4.
Figure 9:
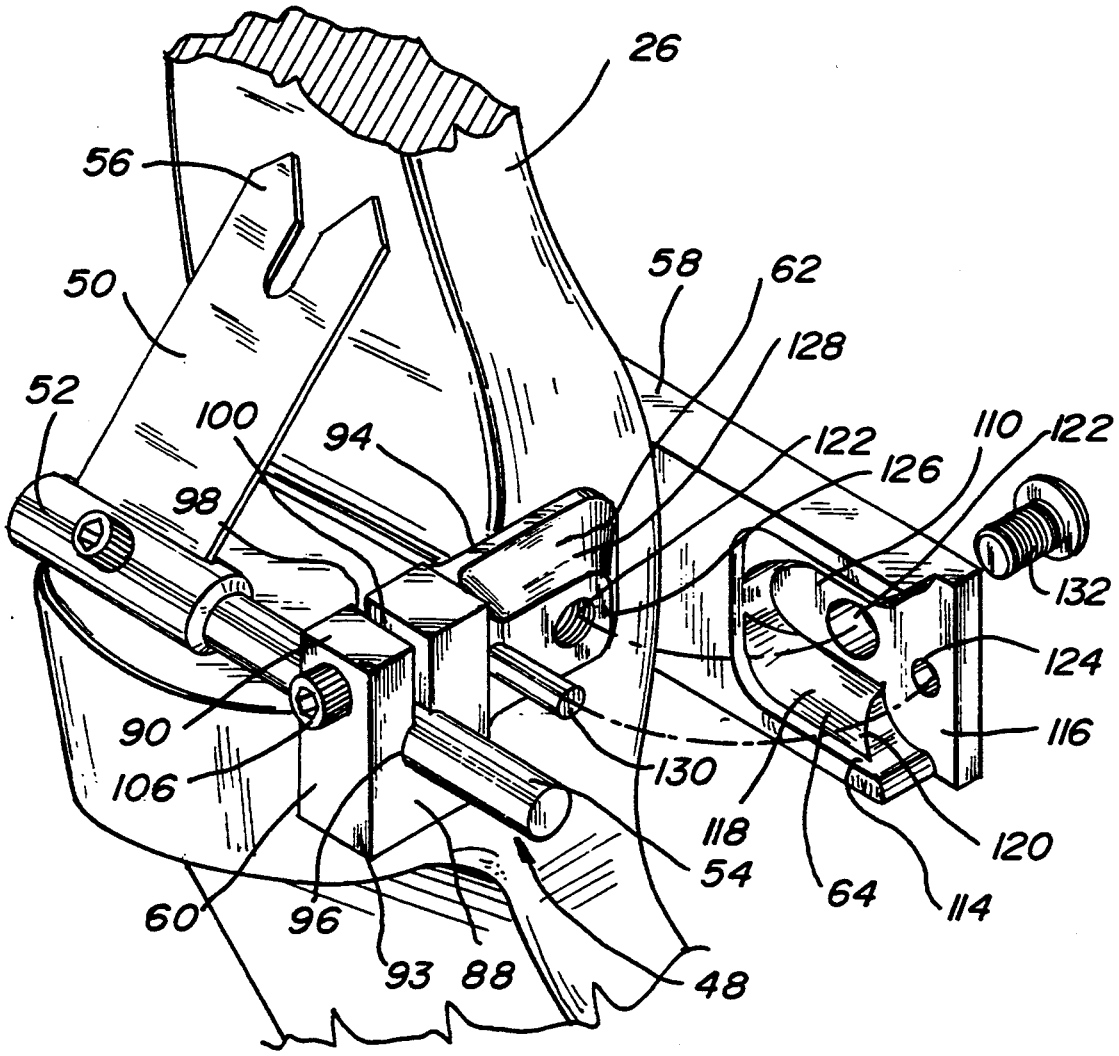
FIG. 9 is an enlarged exploded view of the mounting bracket incorporating the present invention, illustrating the mounting plate attached to the bow and the module positioned prior to connection with the mounting plate.

As shown in FIGS. 4, 5, and 6, when the module 60 and the mounting plate 58 are connected together the alignment surfaces 62 and 64 engage one another and automatically align the module and mounting plate in the predetermined aligned relationship, allowing the module to be removed from and re-attached to the mounting plate in substantially the same predetermined aligned relationship. The fact that the module automatically positions itself in a predetermined aligned relationship with the mounting plate allows the arrow support mechanism 22, attached to the module, to be removed from the mounting plate 58 and reattached to the mounting plate without affecting the calibration of the arrow support mechanism.

Details of the mounting plate 58 and module 60 are shown in FIGS. 4, 5, 6 and 7. The mounting plate is rectangularly shaped having an inner face 66, an outer face 68, and a top and bottom face 70 and 72, respectively. A plurality of mounting apertures 74 are located at a first end 76 of the mounting plate. A fastener, such as a screw 78, is inserted through one of the mounting apertures to attach the mounting plate to the riser 26 just above the handle 36, where a mounting hole (not shown) is located. When attached to the riser, a second end 82 of the mounting plate extends rearwardly away from the riser.

The module 60 comprises a base portion 84 having an inner face 86, an outer face 88, a top and bottom face 90 and 92, respectively, and an end face 93. A longitudinally extending tongue 94 is integrally formed along the inner face 86 of the module 60. An alignment bore 96 is formed through the base portion of the module, and is used for receiving the lateral support rod 48 of the arrow support mechanism 22. A slot 98 extends from the alignment bore 96 through the top face 90 of the module and forms a gap 100 extending along the entire length of the alignment bore 96. An adjustment bore 102 is formed through the end face 93 of the module 60, and passes through the slot 98, terminating within the base portion 84. The terminal portion of the adjustment bore 102 is internally threaded. A calibration fastener, such as a screw 106, is inserted into the adjustment bore and operates in combination with the slot 98 as a clamp 108 to adjust the dimension of the gap 100 formed by the slot, which in turn adjusts the dimension of the alignment bore 96. As the alignment bore 96 reduces in size, the arrow support mechanism 22 becomes fixed in a given position relative to the mounting bracket 20.

Details of the alignment surface 64 on the mounting plate 58 are shown in FIGS. 5, 6, 7 and 9. The alignment surface 64 of the mounting plate 58 is located near the second end 82 of the mounting plate and is formed within a recessed area 110 on the inner face 66 of the mounting plate. The recessed area 110 has a top wall 112, a bottom wall 114, and an outside wall 116, together defining an concave oval-shaped space with an open end 117 towards the second end 82 of the mounting plate 58. The alignment surface 64 is integrally formed along the intersection of the top wall 112 and the outside wall 116, and also along the intersection of the bottom wall 114 and the outside wall 116. The alignment surface 64 is an inclined plane 118 angling between the bottom wall 114 and the outside wall 116, and also between the outside wall 116 and the top wall 112, forming a fillet 120 along those intersections.

The outer face 68 of the mounting plate 58 has a fastener bore 122 and a positioning bore 124 formed therein, the fastener bore 122 being used to releasably connect the mounting plate 58 to the module 60. The positioning bore 124 is used to align the module 60 when it is connected to the mounting plate 58.

Details of the alignment surface 62 on the module 60 are shown in FIGS. 5–9. The tongue 94 has an inner face 86 and an outer face 126 with the alignment surface 62 between the inner face 86 and the outer face 126. The alignment surface 62 is an inclined plane 128 angling from the inner face 86 to the outer face 126. The alignment surface 62 in combination with the outer face 126 has a general convex shape. An alignment pin 130 extends perpendicularly away from the outer face 126 of the tongue 94 for insertion through the positioning bore 124 in the mounting plate 58 when the module 60 and the mounting plate 58 are connected together. The alignment pin acts as a key and assists in positioning the module relative to the mounting plate to effectively engage the alignment surfaces, 62 and 64. The fastener bore 122 continues through the tongue 94. The alignment pin 130 is not a necessary component to the present invention because the fastener bore with the appropriate fastener, such as screw 132, also acts to position the module in the same manner.

In using the mounting bracket 20 of the present invention, the tongue 94 of the module 60 is received within the recessed area 110 on the mounting plate 58, such that the alignment pin 130 is inserted into the positioning bore 124 on the mounting plate 58, as shown in FIG. 6. The alignment pin is inserted through the positioning bore until the alignment surface 62 on the module 60 engages the alignment surface 64 on the mounting plate 58. The engagement of the alignment surfaces 62 and 64 in combination with the insertion of the alignment pin 130 into the alignment bore automatically positions the module 60 and the mounting plate 58 in the predetermined aligned relationship. When the tongue 94 is seated in the recessed area 110, the outer face 126 of the tongue does not engage the outer wall 116 of the recessed portion, forming a gap 127, and thus does not interfere with the seating relationship of the alignment surfaces 62 and 64, as shown in FIGS. 5 and 6.

The module 60 and the mounting plate 58 are releasably secured together by insertion of the fastener 132 through the fastener bore 122. The base of the module 60, when attached to the mounting plate 58, extends beyond the second end 82 of the mounting plate 58 in order to secure the arrow support mechanism 22 independently from the mounting plate 58. When connected, the inner face 86 of the module 60 is continuous and flush with the inner face 66 of the mounting plate 58.

The engagement of the alignment surfaces 62 and acts to positively seat the tongue 94 in the predetermined and repeatable position relative to the mounting plate 58. Because of the seating interaction of the engagement surfaces, when the module 60 is disconnected and reattached to the mounting plate 58, the position of the module relative to the mounting plate when re-attached is substantially identical to the alignment of the module to the mounting plate before the module was disconnected.

The archer then adjusts the arrow support mechanism 22 by using the calibration screw 106 to tighten and loosen the alignment bore 96 around the lateral support rod 48 until the arrow support mechanism 22 is sighted into a satisfactory position. The archer can then remove the module 60 from the mounting plate 58 to sight in another arrow support rest, or simply to protect the previously calibrated arrow support rest from being bent or in any other way misaligned. When the archer wishes to use the arrow support mechanism 22 that was previously calibrated, the archer simply re-attaches the module 60 to the mounting plate 58. In this manner, several different arrow support mechanisms mounted on separate modules can be calibrated for different shooting styles or arrow sizes. The different modules can then be attached to the mounting plate, and the archer can be confident in knowing that the calibration of the arrow support mechanism has been maintained.

A presently preferred embodiment of the present invention and many of its improvements have been described with a degree of particularity. This description has been made by way of a preferred example and is based on a present understanding of knowledge available regarding the invention. It should be understood, however, that the scope of the present invention is defined by the following claims, and not necessarily by the detailed description of the preferred embodiment.

I claim:

1. A mounting bracket mountable on a bow for removably attaching a precisely calibrated arrow support mechanism, said mounting bracket comprising:

a mounting plate defining a first alignment surface;

a module defining a second alignment surface, a key on said module extending from said second alignment surface;

said plate defining a bore opening into said first alignment surface and receiving said key;

a means for aligning said second alignment surface in seating engagement with said first alignment surface when said key is releasably inserted into said bore thereby to repeatably position said module in a predetermined aligned relationship relative to said mounting plate and thereby to the bow.

2. A mounting bracket as defined in claim 1, wherein:

a fastener bore is formed in said mounting plate;

a corresponding threaded fastener bore is formed in said module; and an elongated threaded fastener is inserted through said fastener bore in said mounting plate, and is threadably received in said threaded fastener bore to releasably attach said mounting plate and said module together.

3. A mounting bracket mountable on a bow for removably attaching a precisely calibrated arrow support mechanism, said mounting bracket comprising:

a mounting plate having a first end and a second end, said first end being releasably attachable to the bow, and said second end extending rearwardly away from the bow and defining a longitudinally oriented recessed area, said recessed area defining a first alignment surface;

a module having a base portion and an integrally formed tongue portion extending longitudinally away from said base portion, said tongue defining a second alignment surface;

a key on said tongue portion extending from said second alignment surface, said plate defining a bore opening into said recessed area for receiving said key, said first alignment surface seatingly engaging said second alignment surface when said key is releasably inserted into said bore thereby to repeatably position said module in a predetermined aligned relationship relative to said mounting plate and thereby to the bow.

4. A mounting bracket as defined in claim 3, wherein:

said recessed area has an outside wall, a top wall and a bottom wall;

said first alignment surface being an inclined plane angling from said top wall to said outside wall, and being an inclined plane angling from said bottom wall to said outside wall;

said tongue portion having an inner face and an outer face, and said second alignment surface being an inclined plane angling between said inner face and said outer face; and said inclined planes in said recessed area seatingly engaging said inclined plane on said tongue thereby automatically positioning said module in a predetermined aligned relationship with said mounting plate when said tongue is received in said recessed area.

5. A mounting bracket as defined in claim 4, wherein:

a gap is formed between said outer face of said tongue and said outside wall of said recessed area when said tongue is seated in said recessed area.

6. A mounting bracket as defined in claim 5, wherein:

said mounting plate defining a plurality of mounting apertures to attach said mounting plate onto the bow.

7. A mounting bracket as defined in claim 4, wherein:

a fastener bore is formed in said mounting plate;

a corresponding threaded fastener bore is formed in said module; and an elongated threaded fastener is inserted through said fastener bore in said mounting plate, and is threadably received in said threaded fastener bore to releasably attach said mounting plate and said module together.

8. A mounting bracket having an arrow support mechanism adjustably attached thereto, together forming an arrow rest, said mounting bracket mountable on a bow, the arrow support mechanism precisely supporting an arrow prior to releasing the arrow from the bow, said mounting bracket comprising:

a mounting plate having a first end and a second end, said second end defining a concave alignment surface, said first end removably attachable to the bow;

a module engageable with said mounting plate and defining a convex alignment surface;

a key on said module extending from said convex alignment surface, said plate defining a bore opening into said concave alignment surface for receiving said key;

said convex alignment surface engaging said concave alignment surface when said key is releasably inserted into said bore thereby to repeatably position said module in a predetermined aligned relationship relative to said mounting plate and thereby to the bow.

9. For use on a bow, a detachable calibrated arrow rest and sight comprising, in combination, a mounting plate adapted to be securely mounted on the bow, said mounting plate defining an alignment recess, a module defining a tongue, said tongue having a configuration corresponding to the configuration of said recess for accurately aligning said module and said plate, thereby to repeatedly position said module in a predetermined aligned relationship relative to said mounting plate and said bow, a pin projecting from said module, said plate further defining an aperture opening into said recess for receiving said pin when said module is received in said recess, a fastener for securing said module to said plate, and an arrow rest and sight adjustably mounted on said module for supporting and sighting an arrow relative to said bow.

10. A mounting bracket mountable on a bow for removably attaching a precisely calibrated arrow support mechanism, said mounting bracket comprising:

a mounting plate having a first end, a second end and an inner face, said second end extending rearwardly away from the bow and defining a longitudinally oriented recessed area on said inner face, said recessed area having an outside wall, a top wall and a bottom wall, said mounting plate further defining a positioning bore and a first fastener bore formed therein, and a plurality of mounting apertures at said first end to attach said mounting plate onto the bow adjacent to said inner face;

a module having a base portion, an inner face, an outer face, and a tongue portion integrally formed along said inner face and extending longitudinally away from said base portion, said tongue portion defining a second fastener bore;

an alignment pin secured to said module and extending outwardly therefrom;

a first alignment surface being integrally formed in said recessed area, said first alignment surface comprising an inclined plane angling from said top wall to said outside wall, and an inclined plane angling from said bottom wall to said outside wall;

a second alignment surface being integrally formed on said tongue portion, said second alignment surface being an inclined plane angling between said inner face and said outer face;

a fastener fixably inserted into said fastener bores to releasably connect said module to said mounting plate;

said inclined planes in said recessed area seatingly engaging said inclined plane on said tongue to automatically position said module in a predetermined aligned relationship with said mounting plate when said tongue is received in said recessed area and said alignment pin is extended into said positioning bore, and wherein a gap is formed between said outer face of said tongue and said outside wall of said recessed area when said tongue is seated in said recessed area, and wherein said inner face of said mounting plate and said inner face of said module are flush when said tongue is seated in said recessed area.

* * * * *